US010214020B2

(12) United States Patent
Miyajima

(10) Patent No.: US 10,214,020 B2
(45) Date of Patent: Feb. 26, 2019

(54) LIQUID EJECTING APPARATUS

(71) Applicant: SEIKO EPSON CORPORATION, Tokyo (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/839,389

(22) Filed: Dec. 12, 2017

(65) Prior Publication Data

US 2018/0170065 A1 Jun. 21, 2018

(30) Foreign Application Priority Data

Dec. 16, 2016 (JP) ..... 2016-244836

(51) Int. Cl.
*B41J 2/175* (2006.01)
*B41J 2/14* (2006.01)

(52) U.S. Cl.
CPC ..... *B41J 2/17556* (2013.01); *B41J 2/14233* (2013.01); *B41J 2/175* (2013.01); *B41J 2/17513* (2013.01); *B41J 2/17563* (2013.01); *B41J 2002/14241* (2013.01); *B41J 2002/14362* (2013.01); *B41J 2002/14419* (2013.01)

(58) Field of Classification Search
CPC . B41J 2/17556; B41J 2/16; B41J 2/175; B41J 2/17513; B41J 2/17563; B41J 2002/14241; B41J 2002/14362; B41J 2002/14419
See application file for complete search history.

(56) References Cited

U.S. PATENT DOCUMENTS 8,833,916 B2 * 9/2014 Hara ..... B41J 2/17563 347/84
2006/0152563 A1 * 7/2006 Kumagai ..... B41J 2/17596 347/86
2014/0198144 A1 7/2014 Miyajima

FOREIGN PATENT DOCUMENTS

| | | |
|---|---|---|
| JP | 2007-130824 | 5/2007 |
| JP | 2011-046070 | 3/2011 |
| JP | 2012-126062 | 7/2012 |
| JP | 2014-136358 | 7/2014 |

* cited by examiner

*Primary Examiner* — Lamson Nguyen
(74) *Attorney, Agent, or Firm* — Workman Nydegger

(57) ABSTRACT

A liquid ejecting apparatus includes a back pressure control unit including a back pressure control element that has a first opening, a second opening, a first liquid flow channel that enables the first opening and the second opening to communicate with each other, and a valve body that controls the flow of liquid in the first liquid flow channel, and a housing that houses the back pressure control element and in which a liquid introduction opening that communicates with the first opening and a discharge channel that communicates with the second opening are formed, and a head unit including a third opening connected to the discharge channel of the back pressure control unit, a second liquid flow channel that communicates with the third opening, a first filter disposed in the second liquid flow channel, a pressure generation chamber, a nozzle, and a pressure generation element.

6 Claims, 11 Drawing Sheets

LIQUID EJECTING APPARATUS

This application claims priority under 35 U.S.C. § 119 to Japanese Patent Application No. 2016-244836 filed on Dec. 16, 2016, the entire disclosure of which is expressly incorporated by reference herein.

BACKGROUND

1. Technical Field

The present invention relates to a liquid ejecting apparatus including a head unit that ejects a liquid from a nozzle and a back pressure control unit that supplies a liquid for the head unit, and particularly to an ink jet recording apparatus that ejects ink as a liquid.

2. Related Art

Among liquid ejecting apparatuses each of which ejects a liquid onto a medium to be ejected, for example, an ink jet recording apparatus that ejects ink as a liquid to perform printing on paper or a recording sheet, which is a medium to be ejected, is known.

Moreover, in such an ink jet recording apparatus, ink is supplied from a liquid storage unit such as an ink tank to a head unit via a supply pipe such as a tube, and the ink supplied from the liquid storage unit is discharged from nozzles of the head unit as ink droplets. A back pressure control unit having an on-off valve in the middle of a flow channel is provided on the upstream side of the head unit so that the ink supplied from the liquid storage unit is supplied to the head unit at a predetermined pressure (refer to, for example, JP-A-2012-126062).

Moreover, an ink jet recording apparatus has been proposed in which a liquid storage unit such as an ink cartridge or the like can be directly mounted on a head unit (refer to, for example, JP-A-2007-130824).

However, because a filter for removing dust and air bubbles contained in the ink is provided in the head unit on which an ink cartridge can be directly mounted and a filter is also provided in the back pressure control unit, when the head unit on which an ink cartridge can be mounted and the back pressure control unit are combined, there is a problem that the filter in the back pressure control unit and the filter in the head unit overlap and the pressure loss increases and bubbles accumulate in both filters.

Further, such a problem exists not only in the ink jet recording apparatus but also in a liquid ejecting apparatus that ejects a liquid other than ink.

SUMMARY

An advantage of some aspects of the invention is that a liquid ejecting apparatus capable of increasing the versatility of a head unit, reducing costs, and suppressing an increase in pressure loss and bubble retention is provided.

A liquid ejecting apparatus according to an aspect of the invention includes a back pressure control unit including a back pressure control element that has a first opening, a second opening, a first liquid flow channel that enables the first opening and the second opening to communicate with each other, and a valve body that controls the flow of liquid in the first liquid flow channel, and a housing that houses the back pressure control element and in which a liquid introduction opening that communicates with the first opening and a discharge channel that communicates with the second opening are formed, and a head unit including a third opening connected to the discharge channel of the back pressure control unit, a second liquid flow channel that communicates with the third opening, a first filter disposed in the second liquid flow channel, a pressure generation chamber that communicates with the second liquid flow channel, a nozzle that communicates with the pressure generation chamber, and a pressure generation element that causes a pressure change in liquid in the pressure generation chamber and causes the liquid to be ejected from the nozzle, where a filter is not disposed between the discharge channel of the back pressure control unit and the second opening of the back pressure control element.

In this case, because the first filter is provided in the second liquid flow channel of the head unit, and a filter is not disposed between the discharge channel of the back pressure control unit and the second opening of the back pressure control element, it is possible to suppress a pressure loss caused by the overlapping of two filters and the accumulation of bubbles in both filters.

Moreover, it is preferable that a second filter be disposed between the liquid introduction opening of the back pressure control unit and the first opening of the back pressure control element and that the second filter have an opening ratio higher than that of the first filter. Accordingly, it is possible to suppress a significant increase in pressure loss caused by the second filter. In addition, by providing the second filter, it is possible to suppress entry of foreign matter such as dust contained in the liquid into the downstream side of the second filter, thereby suppressing malfunction of the valve body due to foreign matter.

Moreover, it is preferable that the head unit include a lid portion in which the third opening is formed and which extends between the second liquid flow channel and the back pressure control unit, and one of the third opening and the discharge channel be formed in a protruding shape and the other be formed of an elastic member that is tightly joined to the protruding shape. Accordingly, it is possible to easily attach and detach the head unit to and from the back pressure control unit, and maintenance such as replacement and repair of the back pressure control unit and cleaning of the back pressure control unit can be easily performed. Moreover, instead of the back pressure control unit, it is also possible to directly connect a storage unit that stores a liquid to the head unit. Therefore, because either of the storage unit and the back pressure control unit can be mounted as a head unit, the number of types of the head unit can be reduced, and the cost of the head unit can be reduced. Furthermore, by providing the lid portion, it is possible to prevent the liquid from entering the interior of the head unit when attaching and detaching the back pressure control unit to and from the head unit.

Moreover, it is preferable that the head unit include a lid portion in which the third opening is formed and which extends between the second liquid flow channel and the back pressure control unit and that one of the third opening and the discharge channel have an absorber that absorbs liquid and the other include the first filter connected to the absorber at the liquid surface level. Accordingly, it is possible to easily attach and detach the head unit to and from the back pressure control unit, and maintenance such as replacement and repair of the back pressure control unit and cleaning of the back pressure control unit can be easily performed. Moreover, instead of the back pressure control unit, it is also possible to directly connect a storage unit that stores a liquid to the head unit. Therefore, since it is possible to mount either of the storage unit and the back pressure control unit as the head unit, it is possible to reduce the number of types of the head unit and to reduce the cost of the head unit. Furthermore, by providing the lid portion, it is possible to prevent the liquid from entering the interior of the head unit when attaching and detaching the back pressure control unit to and from the head unit.

Moreover, it is preferable that the back pressure control element have a flexible film forming a portion of a partition wall of the first liquid flow channel, the film be a single layer, and a water vapor barrier property of the housing of the back pressure control unit be higher than a water vapor barrier property of the film. Accordingly, even if a film with a low water vapor barrier property is used, moisture evaporation of the liquid in the first liquid flow channel can be suppressed by the housing. Moreover, because the film with a low water vapor barrier property easily flexes, the responsiveness of the valve body can be improved.

Moreover, it is preferable that two or more back pressure control elements, each of which is the back pressure control element, be provided for the head unit. Accordingly, it is possible to respond flexibly to design change by merely changing the combination of the number of backpressure control elements.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
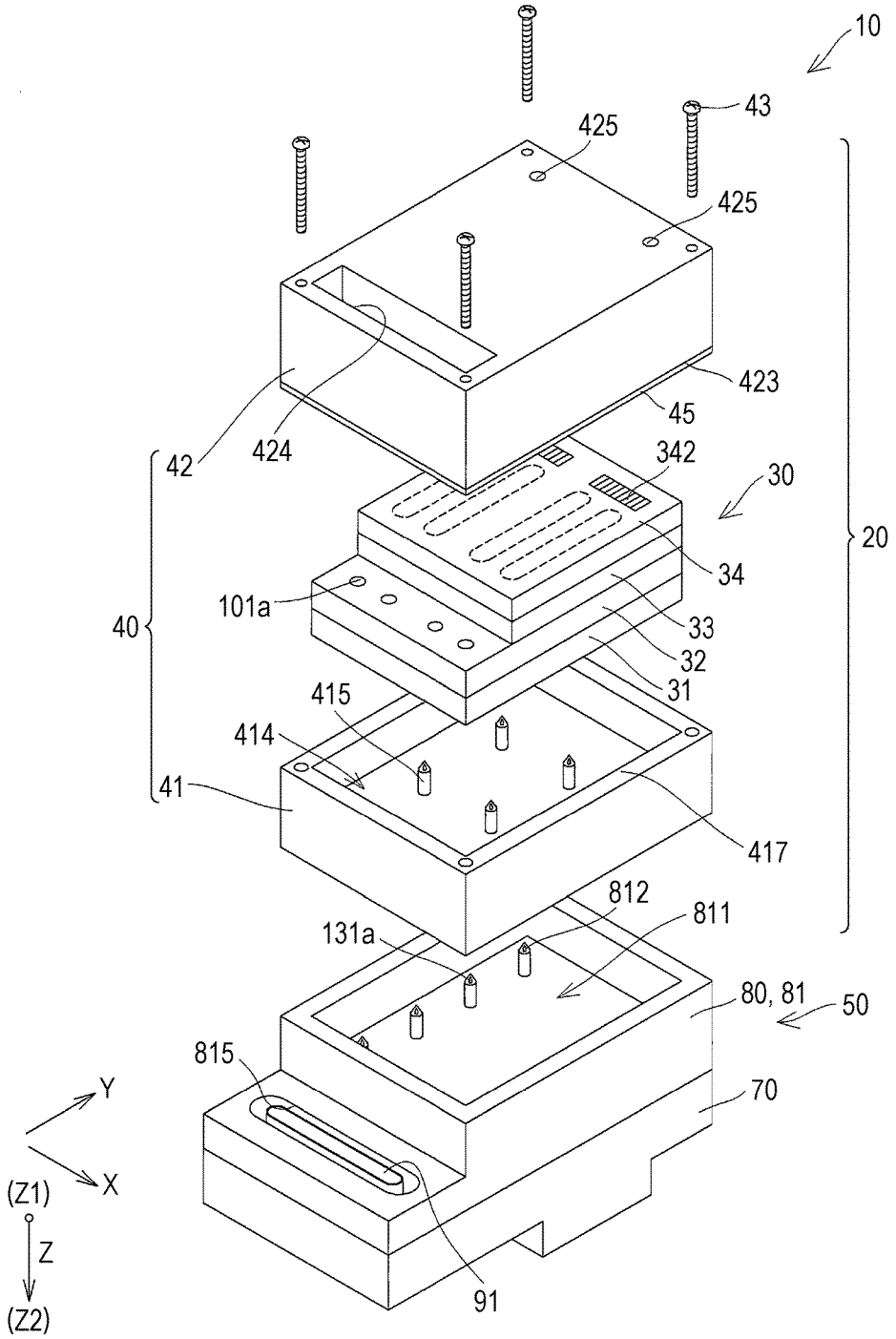
FIG. 1 is an exploded perspective view of a recording head according to Embodiment 1 of the invention.

Hereinafter, embodiments of the invention will be described with reference to the drawings. However, the following description merely illustrates one embodiment of the invention, and it can be arbitrarily changed within the scope of the invention. Moreover, in the drawings, the same reference numerals are given to the same members, and explanations thereof are omitted as appropriate. In each figure, X, Y, and Z represent three spatial axes orthogonal to each other. In the present specification, directions along these axes will be described as a first direction X, a second direction Y, and a third direction Z. Moreover, the third direction Z indicates the vertical direction, the upper side in the vertical direction is referred to as the Z1 side, and the lower side in the vertical direction is referred to as the Z2 side.

Embodiment 1

Figure 2:
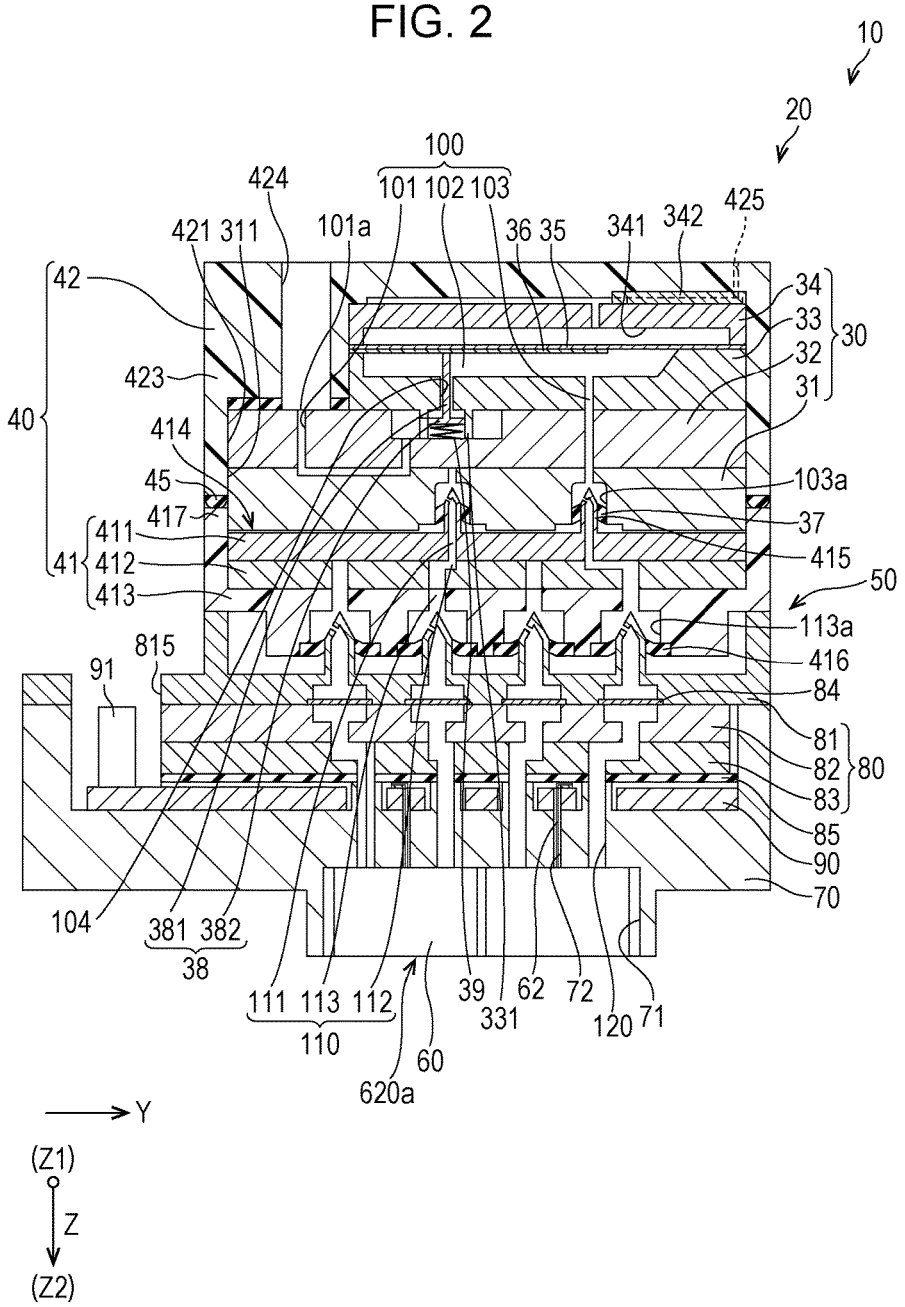
FIG. 2 is a cross-sectional view of the recording head according to Embodiment 1 of the invention.
Figure 3:
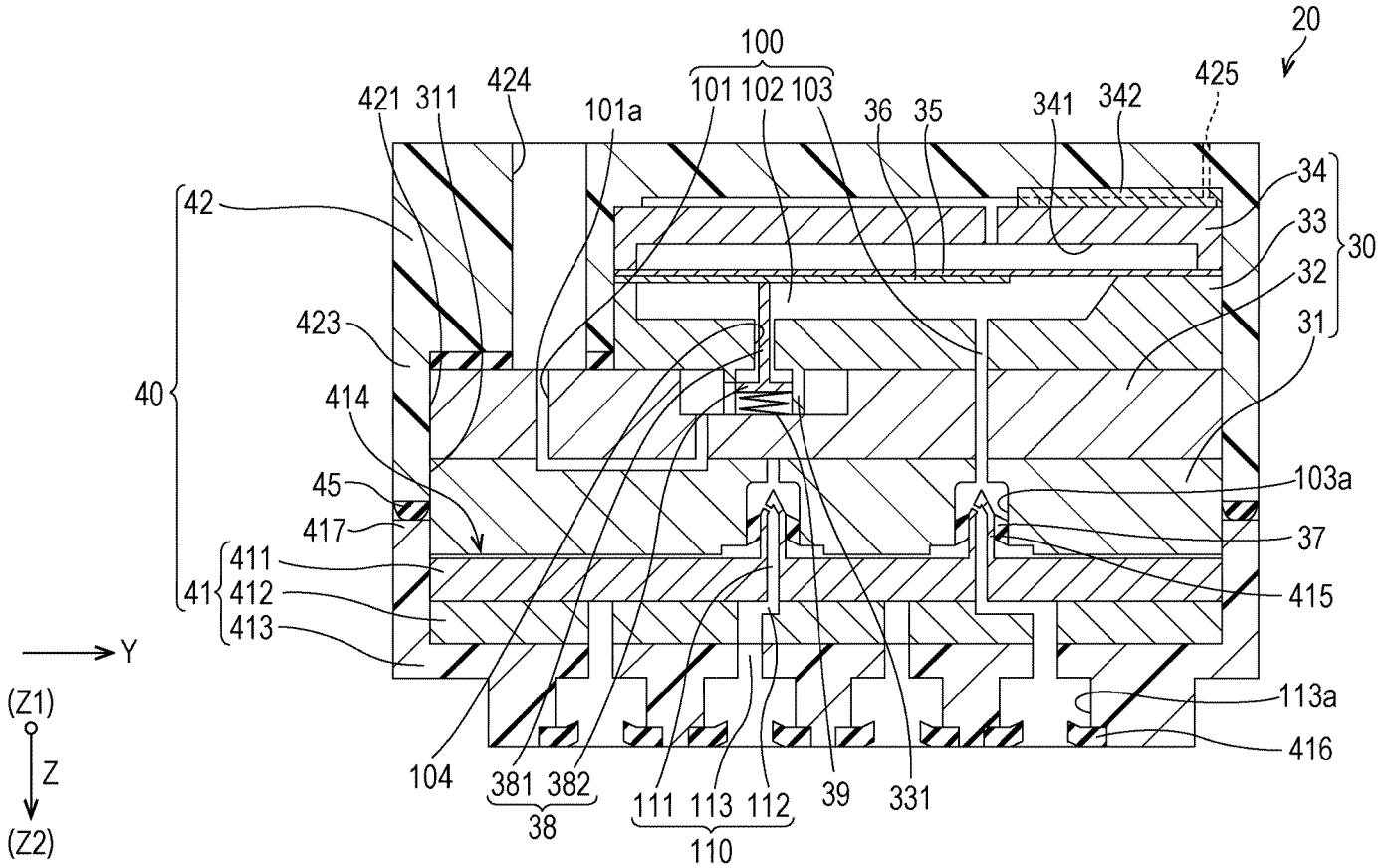
FIG. 3 is a cross-sectional view of a back pressure control unit according to Embodiment 1 of the invention.
Figure 4:
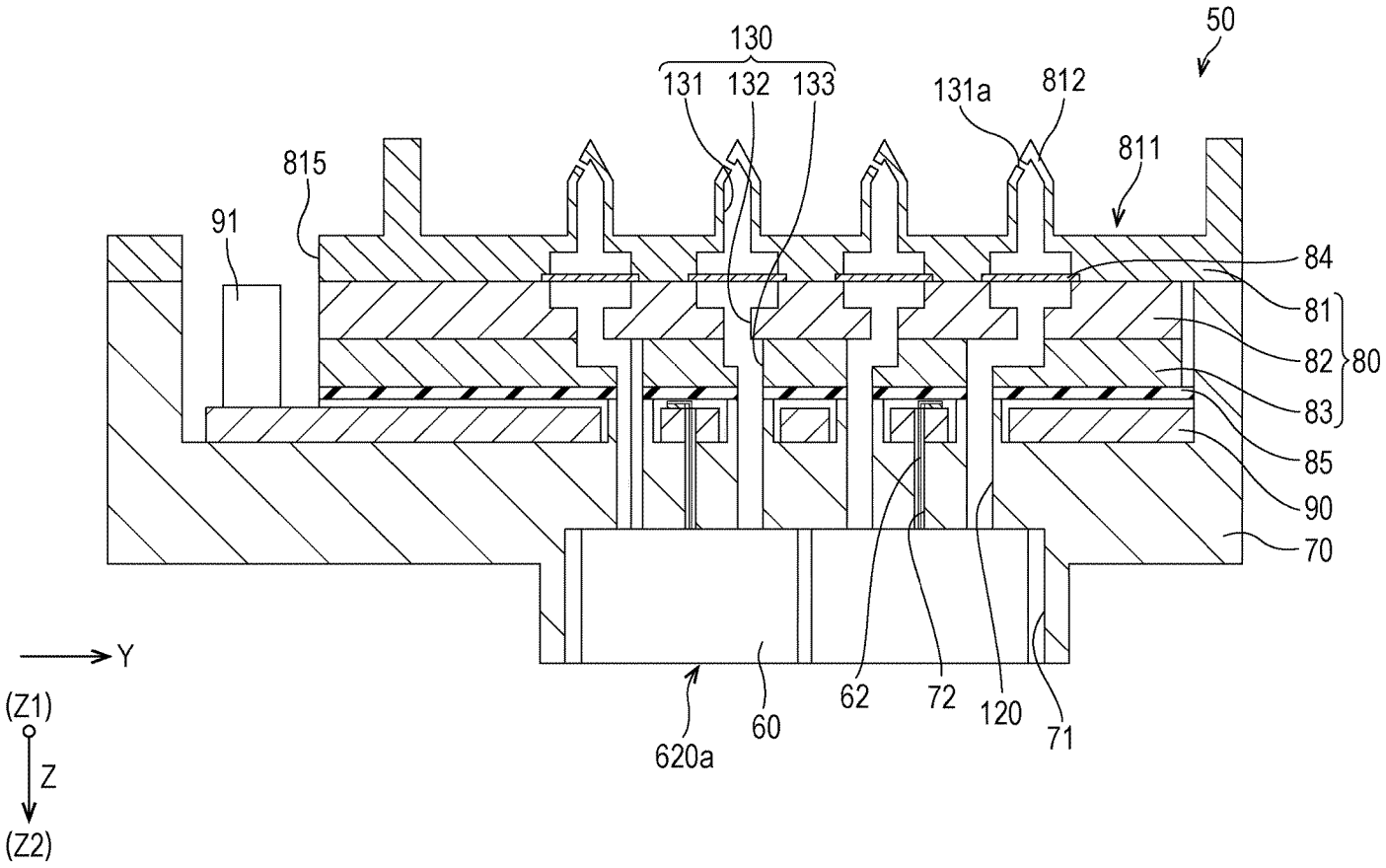
FIG. 4 is a cross-sectional view of a head unit according to Embodiment 1 of the invention.

FIG. 1 is an exploded perspective view of an ink jet recording head which is an example of a liquid ejecting head according to Embodiment 1 of the invention, FIG. 2 is a cross-sectional view of the ink jet recording head, FIG. 3 is a cross-sectional view of a back pressure control unit, and FIG. 4 is a cross-sectional view of a head unit.

As illustrated in FIGS. 1 and 2, an ink jet recording head 10 (hereinafter also referred to as a recording head 10), which is an example of a liquid ejecting head according to Embodiment 1 of the invention, includes a back pressure control unit 20 and a head unit 50 provided on one side of the back pressure control unit 20 in the third direction Z. In this embodiment, the back pressure control unit 20 and the head unit 50 are stacked in the third direction Z, and the side on which the back pressure control unit 20 is disposed is referred to as Z1 and the side on which the head unit 50 is disposed is referred to as Z2.

The back pressure control unit 20 supplies to the head unit 50 ink from a storage unit (not illustrated) such as an ink tank in which ink is stored.

Here, the back pressure control unit 20 will be further described with reference to FIG. 3.

The back pressure control unit 20 includes a back pressure control element 30 and a housing 40 that is a hollow box shaped member in which the back pressure control element 30 is held.

The back pressure control element 30 includes a first flow channel member 31, a second flow channel member 32 provided on the Z1 side of the first flow channel member 31, a pressure chamber forming member 33 provided on the Z1 side of the second flow channel member 32, and a protective plate 34 provided on the Z1 side of the pressure chamber forming member 33.

Each of the first flow channel member 31, the second flow channel member 32, the pressure chamber forming member 33, and the protective plate 34 forming the back pressure control element 30 is formed of a resin material, a metal material, or the like. Moreover, the first flow channel member 31, the second flow channel member 32, the pressure chamber forming member 33, and the protective plate 34 are fixed to each other by adhesion with an adhesive or by welding.

Moreover, first liquid flow channels 100 are provided in the first flow channel member 31, the second flow channel member 32, and the pressure chamber forming member 33.

The first liquid flow channels 100 each include a first introduction channel 101 having a first opening 101*a* opening on the Z1 side surface of the second flow channel member 32, a chamber 102 which is supplied with ink from the first introduction channel 101, and a second introduction channel 103 having a second opening 103*a* that supplies ink from the chamber 102 to the head unit 50 side.

Here, first openings 101*a* are each provided so as to communicate with a liquid introduction opening 424 of the housing 40 described in detail later. The first openings 101*a* such as those described above are provided in a plurality so as to correspond to a plurality of inks. In this embodiment, four of the first openings 101*a* are provided.

Moreover, the first introduction channels 101 having the first openings 101*a* are each formed by a flow channel that passes through the second flow channel member 32 in the third direction Z, a flow channel that extends between the second flow channel member 32 and the first flow channel member 31 in the horizontal direction, and the like. Moreover, a portion of each of the first introduction channels 101 has a concave shape that opens on the Z2 side surface of the pressure chamber forming member 33.

Chambers 102 have a concave shape opening to the Z1 side of the pressure chamber forming member 33. Moreover, each of the chambers 102 communicates with a corresponding one of the first introduction channels 101 at the bottom surface of the chamber 102 at one end in the second direction Y, which is the length direction, and communicates with a corresponding one of second introduction channels 103 at the bottom surface of the chamber 102 at the other end.

The chambers 102 as described above are sealed by a film member 35 provided on the opening surface on the Z1 side of the pressure chamber forming member 33. Here, the film member 35 is a thin film having flexibility, and is fixed to the surface of the pressure chamber forming member 33 by thermal welding or the like. Moreover, the film member 35 is pressure-molded so as to be bent in a dome shape inside the chamber 102. As the film member 35 such as that described above, for example, a material having flexibility such as polyphenylene sulfide (PPS) or the like can be used. As the film member 35, for example, a relatively thin material of about 5 μm to 15 μm can be used. Further, as will be described in detail later, because the film member 35 is covered with the housing 40 having a high water vapor barrier property, the film member 35 can be a single layer composed of a material having a low water vapor barrier property.

Furthermore, elastic plates 36 disposed on the side of the film member 35 are provided in the chambers 102 of the pressure chamber forming member 33. The elastic plates 36 protrude into the chambers 102 in a state where one end side thereof is fixed to the surface of the pressure chamber forming member 33 on the Z1 side and the tip thereof is a free end within the chambers 102. In this embodiment, the elastic plates 36 are formed in a divided comb-tooth shape so as to protrude into the chambers 102 by connecting a plurality of the elastic plates 36 at the fixed end side of the elastic plates 36. The elastic plates 36 bend so as to open and close the first introduction channels 101 through operation of valve bodies 38. Further, the elastic plates 36 may be plate members having elasticity and ink resistance, and in this embodiment, stainless steel plates are used as the elastic plates 36.

The second introduction channels 103 are provided so as to penetrate through the second flow channel member 32 in the thickness direction and penetrate through the first flow channel member 31. Moreover, the second introduction channels 103 may each have a flow channel that extends in the horizontal direction between the pressure chamber forming member 33 and the second flow channel member 32 and between the second flow channel member 32 and the first flow channel member 31. Moreover, second introduction channels 103 are provided so as to open on the Z2 side surface of the first flow channel member 31. In this embodiment, the openings on the Z2 side of the second introduction channels 103 are referred to as the second openings 103*a*. Moreover, first seal members 37 are individually provided inside the second openings 103*a*. First needle members 415 of the housing 40, which will be described in detail later, are inserted into the first seal members 37, and the first liquid flow channels 100 of the back pressure control element 30 and discharge channels 110 of the housing 40 are thereby connected to each other.

Furthermore, the valve bodies 38 that open and close communication between the first introduction channels 101 and the chambers 102 are individually provided between the first introduction channels 101 and the chambers 102. Specifically, cylindrical case portions 331 that extend in the third direction Z inside the first introduction channels 101 are formed on the Z2 side surface of the pressure chamber forming member 33. Each of the case portions 331 allows communication between a corresponding one of the chambers 102 and a corresponding one of the first introduction channels 101. Consequently, the chamber 102 and the first introduction channel 101 communicate with each other via the case portion 331. Here, the valve bodies 38 are individually disposed within the case portions 331. Each of the valve bodies 38 has a shaft portion 381 that is cylindrical and that is inserted through a valve body insertion hole 104 that enables the case portion 331 and the chamber 102 to communicate with each other, and has a flange portion 382 that is shaped like a disc with an outer diameter larger than the outer diameter of the shaft portion 381 provided at the lower end portion of the shaft portion 381 within the case portion 331. The lower end of the shaft portion 381 is connected to the center of the upper surface of the flange portion 382, and the upper end of the shaft portion 381 is in contact with the Z2 side surface of the elastic plate 36 corresponding thereto.

The outer diameter of the flange portion 382 is larger than the inner diameter of the valve body insertion hole 104 and slightly smaller than the inner diameter of the case portion 331. Moreover, a coil spring 39 serving as an urging member is interposed between the Z2 side surface of the flange portion 382 and the second flow channel member 32.

The coil spring 39 is set to urge the valve body 38 corresponding thereto in a direction from Z2 to Z1 (toward the film member 35 side), which is a direction in which the valve body 38 enters a continuously closed state. When the valve body 38 is in the closed state, the flange portion 382 comes into close contact with the upper wall surface of the inside of the case portion 331 and the valve body insertion hole 104 is closed, that is, the chamber 102 and the first introduction channel 101 are in a non-communicating state in which the chamber 102 and the first introduction channel 101 are not in communication with each other.

When the inside of the chamber 102 has a negative pressure as a result of the supply of ink to the head unit 50, due to the difference in pressure between the spaces separated by the film member 35, that is, the difference between the internal pressure of the chamber 102 and the pressure outside the film member 35 opposite to the chamber 102, the film member 35 is displaced so as to bend toward the inside of the chamber 102, that is, toward the Z2 side. As the film member 35 is displaced, the elastic plate 36 elastically deforms so as to curve toward the second flow channel member 32 side.

As a result of the elastic deformation of the elastic plate 36, as illustrated in FIG. 3, the shaft portion 381 pushes the valve body 38 down toward the second flow channel member 32 against the urging force of the coil spring 39, the flange portion 382 separates from the wall surface that opens to the valve body insertion hole 104, and the chamber 102 and the first introduction channel 101 communicate with each other.

In this manner, when the chamber 102 and the first introduction channel 101 communicate with each other, the ink in the first introduction channel 101 flows into the chamber 102. Then, when the chamber 102 and the second introduction channel 103 are sufficiently filled with ink, the negative pressure of the chamber 102 is eliminated, the elastic plate 36 returns to the original state, and by the closing of each of the valve bodies 38 through the urging force of the coil spring 39, the inside of the chamber 102 is always maintained at a constant pressure.

In this way, in this embodiment, the film member 35, the elastic plate 36, the valve body 38 having the shaft portion 381 and the flange portion 382, and the coil spring 39 form a back pressure control valve.

The housing 40 that holds the back pressure control element 30 such as that described above will be described. The housing 40 includes a base portion 41 that is separated in the third direction Z and a cover portion 42.

The base portion 41 is provided with the discharge channels 110 that communicate with the first liquid flow channels 100 of the back pressure control element 30. In this embodiment, since four of the first liquid flow channels 100 are provided, the number of the discharge channels 110 is the same as that of the first liquid flow channels 100, that is, four are provided.

Moreover, the base portion 41 of this embodiment includes a first base portion 411 provided on the Z1 side, a second base portion 412 provided on the Z2 side of the first base portion 411, and a third base portion 413 provided on the Z2 side of the second base portion 412.

The surface of the first base portion 411 on the Z1 side, which is the back pressure control element 30 side, is a first mounting portion 414 on which the back pressure control element 30 is mounted. The first needle members 415 that are to be inserted into the back pressure control element 30 and that are needle-like are integrally provided in the first mounting portion 414 of the first base portion 411. In the inside of each of the first needle members 415, a first discharge channel 111 forming the discharge channel 110 is provided so as to open at the tip of the first needle member 415. Further, in this embodiment, the first needle members 415 are provided in the same number as the discharge channels 110, that is, four of the needle members 415 are provided.

The second base portion 412 is provided on the Z2 side of the first base portion 411. The second base portion 412 is provided with second discharge channels 112 that communicate with the first discharge channels 111 of the first base portion 411 so as to form the discharge channels 110. Further, although not specifically illustrated, the second discharge channels 112 of the second base portion 412 may each have a horizontal flow channel that is arranged so as to extend in a horizontal direction orthogonal to the third direction Z, that is, a direction including the first direction X and the second direction Y.

The third base portion 413 is provided on the Z2 side of the second base portion 412. Third discharge channels 113 that communicate with the second discharge channels 112 of the second base portion 412 and form the discharge channels 110 are provided in the third base portion 413. That is, in this embodiment, the discharge channels 110 each include the first discharge channel 111 provided in the first base portion 411, a second discharge channel 112 provided in the second base portion 412, and the third discharge channel 113 provided in the third base portion 413. Moreover, the third discharge channels 113 forming the discharge channels 110 are provided so as to open on the Z2 side surface of the third base portion 413. In this embodiment, the opening on the Z2 side of each of the third discharge channels 113 is referred to as a liquid discharge opening 113*a*. Second seal members 416 are provided inside the liquid discharge openings 113*a*, second needle members 812 of the head unit 50, which will be described in detail later, are inserted into the second seal members 416, and the liquid discharge openings 113*a* and the second liquid flow channels of the head unit 50 are thereby connected to each other.

The first base portion 411, the second base portion 412, and the third base portion 413 such as those described above are fixed by, for example, adhesion with an adhesive or welding, fastening by screwing on screws, or the like.

Moreover, the third base portion 413 is provided with a first wall portion 417 that covers side surfaces of the first base portion 411 and the second base portion 412. That is, the first base portion 411 and the second base portion 412 are housed in the concave portion formed by the first wall portion 417 of the third base portion 413.

The back pressure control element 30 is mounted on the first mounting portion 414 of the base portion 41 such as that described above. In this embodiment, by inserting the first needle members 415 that are provided in the first mounting portion 414 and that protrude toward the back pressure control element 30 into the second openings 103*a* provided in the back pressure control element 30 and by bringing the first seal members 37 in the second openings 103*a* into close contact with the first needle members 415, the first liquid flow channels 100 of the back pressure control element 30 and the discharge channels 110 of the base portion 41 communicate with each other.

The cover portion 42 has a size that covers the first mounting portion 414 of the base portion 41 and has a holding portion 421 that is concave and that opens toward the base portion 41 side so as to oppose the first mounting portion 414 of the base portion 41. As illustrated in FIG. 1, the cover portion 42 is fastened to the first wall portion 417 of the third base portion 413 of the base portion 41 with fixing screws 43.

Here, the cover portion 42 is provided with a second wall portion 423 defining a side surface of the holding portion 421. Therefore, the base portion 41 and the cover portion 42 are fixed by bringing the tip surface of the first wall portion 417 and the tip surface of the second wall portion 423 into contact with each other. In this embodiment, a third seal member 45 made of rubber, elastomer or the like is interposed between the first wall portion 417 and the second wall portion 423. The third seal member 45 may be formed separately from the base portion 41 and the cover portion 42 or may be integrally formed with the base portion 41 or the cover portion 42 by two-color molding or the like.

The housing 40 such as that described above, specifically, the third base portion 413 of the base portion 41 and the cover portion 42 are formed of a resin material having a high water vapor barrier property, for example, modified polyphenylene ether (PPE) or the like. Here, that the water vapor barrier property is high means that the amount of water vapor permeating through the material is small, that is, the water vapor permeability is low. Moreover, that the water vapor barrier property of the housing 40 is high means that the water vapor barrier property is higher than that of the material forming the first liquid flow channel 100 of the back pressure control element 30. In the back pressure control element 30, because the material having the lowest water vapor barrier property is the film member 35, it is preferable to use a material having a higher water vapor barrier property than that of the film member 35 for the housing 40. By using a material having a higher water vapor barrier property than the back pressure control element 30 as the housing 40 in this manner, evaporation of moisture in the ink that has passed through the film member 35 of the back pressure control element 30 can be suppressed. Therefore, as the film member 35, it is possible to use a material that has a low water vapor barrier property and is easy to flex.

Moreover, the liquid introduction opening 424 that communicates with the first openings 101*a* of the first liquid flow channel 100 of the back pressure control element 30 is provided on the Z1 side surface of the cover portion 42. The liquid introduction opening 424 of this embodiment has a size that enables common communication with the plurality of first openings 101*a*. Then, in a state in which a supply pipe (not illustrated) which is a tubular member such as a tube is inserted through the liquid introduction opening 424 of the cover portion 42, the supply pipe and the first openings 101*a* are connected to each other. Of course, the configuration is not limited to this, and the liquid introduction opening 424 may be provided so as to communicate with each of the first openings 101*a*, and the supply pipe may be connected to the liquid introduction opening 424.

Moreover, on the Z2 side surface of the protective plate 34 of the back pressure control element 30 on the side of the pressure chamber forming member 33, a film holding portion 341 that has a concave shape and which is a space that opposes each chamber 102 and allows deformation of the film member 35 is provided. The cover portion 42 of the housing 40 is provided with air release channels 425 that communicate with the outside for releasing the air of the film holding portion 341 to the outside. Further, the protective plate 34 is provided with serpentine channels 342 which are meandering grooves having a concave shape that communicate with the air release channels 425. The serpentine channels 342 enable the film holding portion 341 and the air release channels 425 to communicate with each other and are each provided with a long channel with a narrow sectional area so that it is possible to suppress diffusion of moisture from the film member 35 by imparting diffusion resistance to the serpentine channels 342. Moreover, by providing the air release channels 425, the film holding portion 341 can be open to the atmosphere, and hindering the deformation of the film member 35 due to the pressure inside the film holding portion 341 can be suppressed.

In this manner, the back pressure control unit 20 has a structure in which the back pressure control element 30 is covered with the housing 40 having a high water vapor barrier property. Therefore, evaporation of moisture from the back pressure control element 30 can be suppressed by the housing 40. In this manner, since evaporation of moisture in the back pressure control element 30 can be suppressed by the housing 40, a material having a relatively low water vapor barrier property can be used as the film member 35 of the back pressure control element 30. That is, as the film member 35, a film member having a relatively small thickness and formed of a single layer of easily deformable material such as PPS can be used. As described above, by using the film member 35 having a relatively small thickness and formed of a single layer, flexibility can be easily achieved. Accordingly, it is possible to improve the responsiveness of the film member 35 in response to the difference between the pressure in the chamber 102 and the pressure in the film holding portion 341 separated by the film member 35 from the chamber 102, and improve the opening and closing performance of the valve body 38.

If the film member 35 having a relatively large thickness is used in order to suppress evaporation of moisture from the film member 35, the responsiveness of the film member 35 in response to the pressure difference is reduced. Moreover, even if the film member 35 is formed by laminating different materials, the flexibility is lowered and the responsiveness is lowered. Therefore, even when the pressure in the chamber 102 reaches a desired pressure, there is a possibility that problems such as the valve not opening may occur. In this embodiment, because the responsiveness of the film member 35 with respect to the pressure in the chamber 102 can be improved by easily allowing the film member 35 to be deflectable while suppressing evaporation of moisture from the film member 35, it is possible to improve the opening and closing property of the valve body 38 and to suppress the occurrence of supply problems such as poor supply of ink and excessive supply of ink.

Moreover, in the back pressure control unit 20 of this embodiment, the base portion 41 and the cover portion 42 forming the housing 40 are fixed by the fixing screws 43. Therefore, the housing 40 can be easily disassembled and assembled. Moreover, the connection between the discharge channel 110 of the housing 40 and the first liquid flow channel 100 of the back pressure control element 30 is performed by inserting the first needle members 415 that are provided with the base portion 41 of the housing 40 in a protruding shape protruding toward the back pressure control element 30 into the second openings 103*a* and tightly joining the first seal members 37 to the first needle members 415. That is, in the first mounting portion 414 of the housing 40, attachment and detachment of the back pressure control element 30 can be easily performed. Therefore, maintenance such as replacement and repair of the back pressure control element 30 and cleaning of the back pressure control element 30 can be easily performed.

Here, the head unit 50 will be further described with reference to FIG. 4. The head unit 50 includes a plurality of head main bodies 60 that eject ink, a head holder 70 that holds the head main bodies 60, a lid member 80 extending between the head holder 70 and the back pressure control unit 20, and an intermediate substrate 90, which is a circuit board held between the head holder 70 and the lid member 80.

Figure 5:
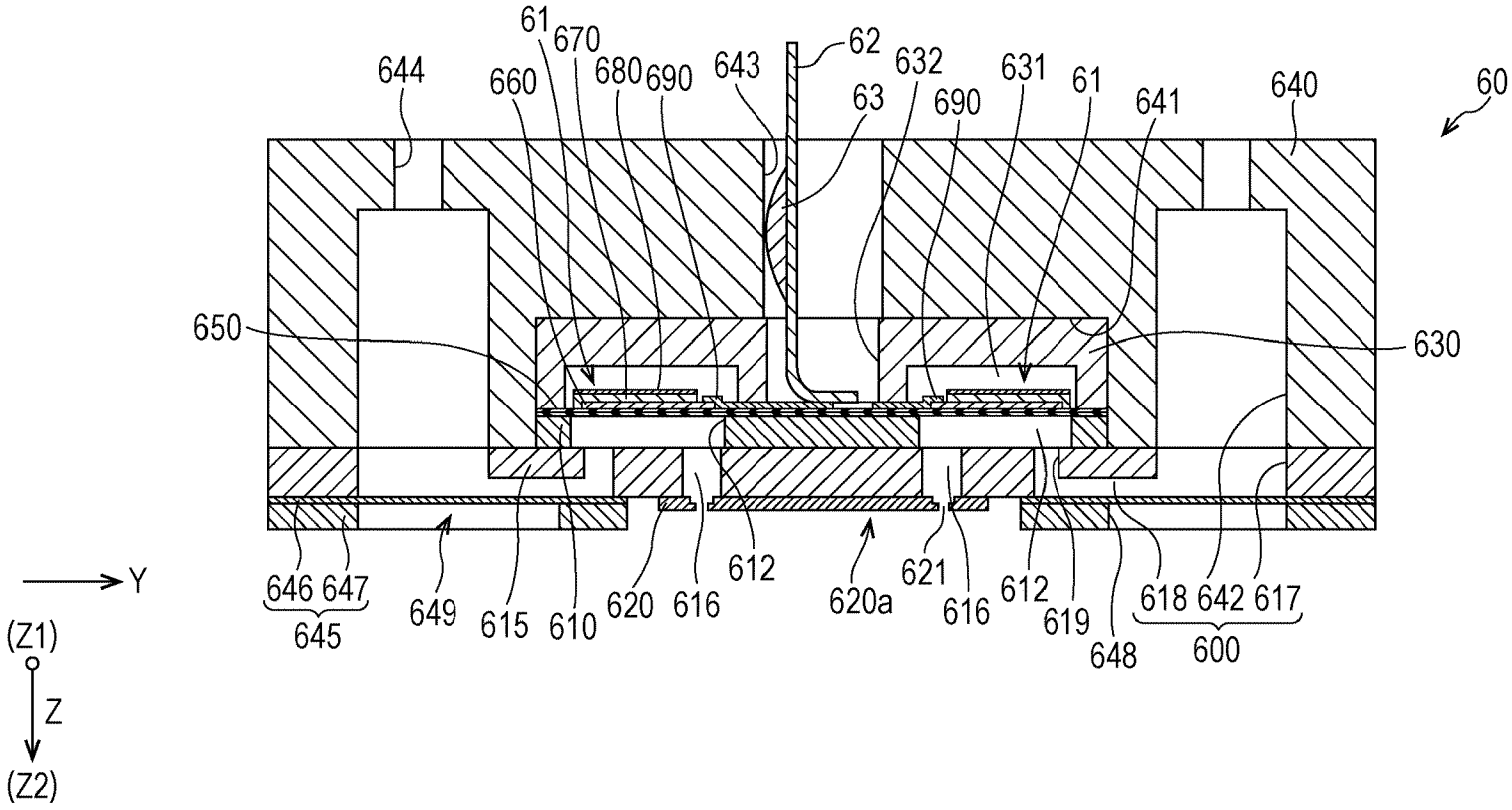
FIG. 5 is a cross-sectional view of a head main body according to Embodiment 1 of the invention.

Here, the head main bodies 60 will be described with reference to FIG. 5. Further, FIG. 5 is a cross-sectional view illustrating a head main body. Moreover, the head main body 60 will be described on the basis of its direction when mounted on the ink jet recording head, that is, on the basis of the first direction X, the second direction Y, and the third direction Z.

As illustrated in FIG. 5, a flow channel forming substrate 610 forming the head main body 60 of this embodiment is subjected to anisotropic etching from one surface side, whereby pressure generation chambers 612 partitioned by a plurality of partition walls are formed so as to be arranged in parallel along the first direction X in which a plurality of nozzles 621 that eject ink droplets are also arranged in parallel. Moreover, in the flow channel forming substrate 610, the pressure generation chambers 612 are arranged in a plurality of rows in parallel in the first direction X; in this embodiment, they are arranged in two rows in the second direction Y.

A communication plate 615 and a nozzle plate 620 are sequentially laminated on the Z2 side of the flow channel forming substrate 610 such as that described above, which is one surface side of the flow channel forming substrate 610 in the third direction Z.

The communication plate 615 is provided with nozzle communication channels 616 that enable the pressure generation chambers 612 and the nozzles 621 to communicate with each other. The communication plate 615 has a larger area than the flow channel forming substrate 610, and the nozzle plate 620 has a smaller area than the flow channel forming substrate 610. In this embodiment, the surface of the nozzle plate 620 to which the nozzles 621 open and from which ink droplets are ejected is referred to as a liquid ejecting surface 620*a*.

Moreover, the communication plate 615 is provided with first manifold portions 617 and second manifold portions 618 which form portions of manifolds 600. The first manifold portions 617 penetrate the communication plate 615 in the third direction Z. Moreover, the second manifold portions 618 are provided so as to open on the nozzle plate 620 side of the communication plate 615 without penetrating the communication plate 615 in the third direction Z.

Furthermore, supply communication channels 619 that communicate with one end portion of the pressure generation chambers 612 in the second direction Y are provided independently for each of the pressure generation chambers 612 in the communication plate 615. The supply communication channels 619 enable the second manifold portions 618 and the pressure generation chambers 612 to communicate with each other.

The nozzles 621 that communicate with the pressure generation chambers 612 via the nozzle communication channels 616 are formed in the nozzle plate 620.

In contrast, a diaphragm 650 is formed on the Z1 side of the flow channel forming substrate 610, which is the side of the flow channel forming substrate 610 opposite to the communication plate 615, and on the diaphragm 650, a first electrode 660, piezoelectric layers 670, and second electrodes 680 are laminated by a film formation and lithography method to form piezoelectric actuators 61. In this embodiment, the piezoelectric actuators 61 are pressure generation elements that cause a pressure change in the ink in the pressure generation chambers 612. Here, each of the piezoelectric actuators 61 is also referred to as a piezoelectric element 61, and refers to a portion including the first electrode 660, the piezoelectric layer 670, and the second electrode 680. Generally, one of the electrodes of the piezoelectric actuator 61 is used as a common electrode, and the other electrode and the piezoelectric layer 670 are patterned for each of the pressure generation chambers 612. In this embodiment, the first electrode 660 is used as the common electrode of the piezoelectric actuator 61 and the second electrodes 680 are used as the individual electrodes of the piezoelectric actuators 61; however, there is no problem even if the electrodes are reversed for convenience of the arrangement of the drive circuit and wiring. Further, in the above example, the diaphragm 650 and the first electrode 660 act as a diaphragm, but, of course, the configuration is not limited thereto; for example, without providing the diaphragm 650, only the first electrode 660 may act as a diaphragm. Moreover, each of the piezoelectric actuators 61 may also substantially function as a diaphragm.

Moreover, lead electrodes 690 are respectively connected to the second electrodes 680 of the respective piezoelectric actuators 61 such as those described above, and voltages are selectively applied to the respective piezoelectric actuators 61 via the lead electrodes 690.

A protective substrate 630 having substantially the same size as the flow channel forming substrate 610 is joined to the surface of the flow channel forming substrate 610 on the piezoelectric actuator 61 side. The protective substrate 630 has actuator holding portions 631 which are spaces for protecting the piezoelectric actuators 61. The actuator holding portions 631 are provided independently for each row of the piezoelectric actuators 61. Moreover, in the protective substrate 630, a through hole 632 penetrating in the third direction Z is provided between the two actuator holding portions 631. The vicinity of the end portion of the lead electrodes 690 drawn out from the piezoelectric actuators 61 is provided so as to be exposed in the through hole 632. One end of a flexible cable 62 is connected to the end portion of the lead electrodes 690 exposed in the through hole 632. The flexible cable 62 is formed of a wiring substrate having flexibility, and a drive circuit 63 such as a circuit board or a semiconductor integrated circuit (IC) is mounted thereon.

Moreover, a case member 640 that defines the manifolds 600 that communicate with the plurality of pressure generation chambers 612 together with the flow channel forming substrate 610 is fixed on the protective substrate 630. The case member 640 has substantially the same shape in plan view as the communication plate 615 described above and is joined to the protective substrate 630 and to the communication plate 615 described above. Specifically, the case member 640 has a concave portion 641 having a sufficient depth to house the flow channel forming substrate 610 and the protective substrate 630 on the protective substrate 630 side thereof. The concave portion 641 has an opening area larger than the surface of the protective substrate 630 joined to the flow channel forming substrate 610. The opening face of the concave portion 641 on the side of the nozzle plate 620 is sealed by the communication plate 615 in a state where the flow channel forming substrate 610 and the like are accommodated in the concave portion 641. Moreover, in the case member 640, third manifold portions 642 having a concave shape are provided outside the concave portion 641. The manifolds 600 of this embodiment are each formed by the first manifold portion 617 and the second manifold portion 618 provided in the communication plate 615 and the third manifold portion 642 provided in the case member 640.

Moreover, a compliance substrate 645 is provided on a surface of the communication plate 615 to which the first manifold portion 617 and the second manifold portion 618 open. The compliance substrate 645 seals the opening of the first manifold portion 617 and the second manifold portion 618 on the side of the liquid ejecting surface 620*a*. In this embodiment, the compliance substrate 645 such as that described above includes a sealing film 646 made of a thin film having flexibility and a fixed substrate 647 made of a hard material such as metal. Because the region of the fixed substrate 647 facing the manifolds 600 is an opening portion 648 completely removed in the thickness direction, one surface of the manifolds 600 is a compliance portion 649 which is a flexible portion sealed only with the sealing film 646 having flexibility.

Further, the case member 640 is provided with head introduction channels 644 for communicating with the manifolds 600 and supplying ink to each of the manifolds 600. Moreover, the case member 640 is provided with a connection port 643 which communicates with the through hole 632 of the protective substrate 630 and through which the flexible cable 62 is inserted.

In each of the head main bodies 60 such as those described above, when ejecting ink, ink is taken from the head introduction channels 644, and the inside of the flow channel is filled with ink from the manifolds 600 to the nozzles 621. Thereafter, according to a signal from the drive circuit 63, a voltage is applied to each of the piezoelectric actuators 61 corresponding to the pressure generation chambers 612, so that the diaphragm 650 together with the piezoelectric actuators 61 is bent and deformed. As a result, the pressure in the pressure generation chambers 612 increases, and ink droplets are ejected from predetermined ones of the nozzles 621.

As illustrated in FIG. 4, the head holder 70 such as that described above that holds the head main bodies 60 is provided with a head holding portion 71 having a concave shape opening toward the Z2 side. A plurality of the head main bodies 60 are held in the head holding portion 71 of the head holder 70; in this embodiment, two head main bodies 60 are held. In addition, insertion holes 72 which penetrate in the third direction Z and through which flexible cables 62 are inserted are provided in the head holder 70. Moreover, the flexible cables 62 of the head main bodies 60 held by the head holding portion 71 are drawn out to the surface on the Z1 side through the insertion holes 72. Further, the intermediate substrate 90 as an electronic circuit board is provided on the Z1 side surface of the head holder 70 and the flexible cables 62 of the two head main bodies 60 are electrically connected in common to the intermediate substrate 90. In this embodiment, the intermediate substrate 90 is made of a plate-like rigid board, and wiring, electronic components, and the like (not illustrated) are mounted thereon. Moreover, a connector 91 is provided on the Z1 side surface of the intermediate substrate 90, and external wiring (not illustrated) is electrically connected to the intermediate substrate 90 via the connector 91.

The head holder 70 is provided with holder communication channels 120 that enable the lid member 80 and the head introduction channels 644 of the head main bodies 60 to communicate with each other. One end of the holder communication channels 120 opens to the head holding portion 71 and communicates with the head introduction channels 644 of the head main bodies 60. Moreover, the other end of the holder communication channels 120 is provided so as to open to the intermediate substrate 90 side on the Z1 side.

The lid member 80 is disposed so as to cover the Z1 side surface of the intermediate substrate 90. The lid member 80 has a first lid member 81 provided on the Z1 side thereof, a second lid member 82 provided on the Z2 side of the first lid member 81, and a third lid member 83 provided on the Z2 side of the second lid member 82.

Moreover, the lid member 80 is provided with supply channels 130 that communicate with the liquid discharge openings 113*a* (see FIG. 2) of the back pressure control unit 20 and that supply the head main bodies 60 with ink supplied from the back pressure control unit 20 via the holder communication channels 120 of the head holder 70. Further, it should be noted that the number of the supply channels 130 is the same as that of the liquid discharge openings 113*a* of the back pressure control unit 20, that is, four supply channels are provided.

The Z1 side surface of the first lid member 81 on the side of the back pressure control unit 20 is a second mounting portion 811 on which the back pressure control unit 20 is mounted. The second needle members 812 that are needle-like and that are to be inserted into the back pressure control unit 20 are integrally provided in the second mounting portion 811 of the first lid member 81. Inside the second needle members 812, first supply channels 131 forming the supply channels 130 are provided so as to open at the tip of the second needle members 812. In this embodiment, the openings of the first supply channels 131 at the tip of the second needle members 812 are referred to as third openings 131*a*. Moreover, the first lid member 81 is provided with an external wiring insertion hole 815 through which external wiring connected to the connector 91 of the intermediate substrate 90 is inserted. The external wiring (not illustrated) is connected to the connector 91 of the intermediate substrate 90 via the external wiring insertion hole 815 of the first lid member 81.

The second lid member 82 is provided on the Z2 side surface of the first lid member 81. The second lid member 82 is provided with second supply channels 132 that communicate with the first supply channels 131 of the first lid member 81 and form the supply channels 130. Moreover, each of the connection portions of the first supply channels 131 and the second supply channels 132 has an opening wider than the other remaining portions of the first supply channels 131 and the second supply channels 132, and a first filter 84 crossing each of the supply channels 130 is provided therein. The first filter 84 is a filter member for capturing foreign matter such as dust and air bubbles contained in the ink, for example, a sheet-like film member in which a plurality of fine pores are formed by finely weaving or knitting fibers such as fibers composed of a metal or a resin, or a film member in which a plurality of micropores penetrate through a plate-shaped member such as one composed of a metal or a resin can be used. Moreover, as the first filter 84, a nonwoven fabric such as one composed of a metal or a resin may be used.

The third lid member 83 is provided on the Z2 side of the second lid member 82. Moreover, the third lid member 83 is provided with third supply channels 133 which communicate with the second supply channels 132 of the second lid member 82 and form the supply channels 130. That is, in this embodiment, the supply channels 130 include the first supply channels 131 provided in the first lid member 81, the second supply channels 132 provided in the second lid member 82, and the third supply channels 133 provided in the third lid member 83. The third supply channels 133 are arranged so as to extend between the second lid member 82 and the third lid member 83 in the horizontal direction that includes the first direction X and the second direction Y. The third supply channels 133 forming the supply channels 130 are provided so as to open on the Z2 side surface of the third lid member 83. Moreover, the Z2 side openings of the supply channels 130 are connected to the holder communication channels 120 of the head holder 70. Further, each of the connection portions between the supply channels 130 and the holder communication channels 120 is sealed by a fourth seal member 85.

The first lid member 81, the second lid member 82, and the third lid member 83 such as those described above forming the lid member 80 are fixed to each other by adhesion with an adhesive, welding, fastening by screwing on screws, or the like.

Then, by inserting the second needle members 812, which project toward the Z1 side of the lid member 80, into the liquid discharge openings 113*a* of the back pressure control unit 20, the supply channels 130 of the lid member 80 and the discharge channels 110 of the back pressure control unit 20 are connected to each other.

Because the Z1 side surface of the intermediate substrate 90 is covered with the lid member 80 such as that described above, it is possible to prevent the ink leaked when attaching and detaching the back pressure control unit 20 to and from the lid member 80 from adhering to the intermediate substrate 90. That is, in the case where the back pressure control unit 20 is directly connected to the head holder 70 without providing the lid member 80, when ink leaks at the time of attachment and detachment of the back pressure control unit 20, ink adheres to the intermediate substrate 90 and a fault such as a short circuit occurs.

The head unit 50 of this embodiment is formed by the head main bodies 60, the head holder 70, the lid member 80 and the intermediate substrate 90 such as those described above. Further, in this embodiment, the flow channel from the head introduction channels 644 of the head main bodies 60 to the pressure generation chambers 612, the holder communication channels 120 of the head holder 70, and the supply channels 130 of the lid member 80 constitute the second liquid flow channel of the head unit 50.

Then, as illustrated in FIG. 2, the connection between the third openings 131*a* of the second liquid flow channel of the head unit 50 and the liquid discharge openings 113*a* of the back pressure control unit 20 is performed by inserting the second needle members 812 provided in the lid member 80 and provided in a protruding shape protruding toward the Z1 side into the liquid discharge openings 113*a* of the back pressure control unit 20 and tightly joining the second seal members 416 to the second needle members 812. In other words, the back pressure control unit 20 can be easily attached to and detached from the second mounting portion 811 of the head unit 50. Therefore, maintenance such as replacement and repair of the back pressure control unit 20 and cleaning of the back pressure control unit 20 can be easily performed.

Moreover, because the second needle members 812 are provided in the second mounting portion 811 of the head unit 50 and the back pressure control unit 20 is attachable to and detachable from the second mounting portion 811 of the head unit 50, instead of connecting the back pressure control unit 20, it is also possible to directly connect an ink cartridge or the like that stores ink. That is, the head unit 50 according to this embodiment can be used also for an ink jet recording head on which ink cartridges can be mounted, as well as an ink jet recording head on which the back pressure control unit 20 can be mounted. Therefore, it is not necessary to prepare a dedicated head unit for each of the ink cartridges and the back pressure control unit 20, the number of types of the head unit 50 can be reduced, and the cost of the head unit 50 can be reduced.

As described above, in the recording head 10 of this embodiment, the first filter 84 is provided in the second liquid flow channel of the head unit 50 and no filter is disposed between the liquid discharge openings 113*a* of the back pressure control unit 20 and the second openings 103*a* of the back pressure control element 30. Therefore, it is possible to prevent pressure loss due to the overlapping of two filters from becoming large and to prevent bubbles from accumulating in both filters.

Embodiment 2

Figure 6:
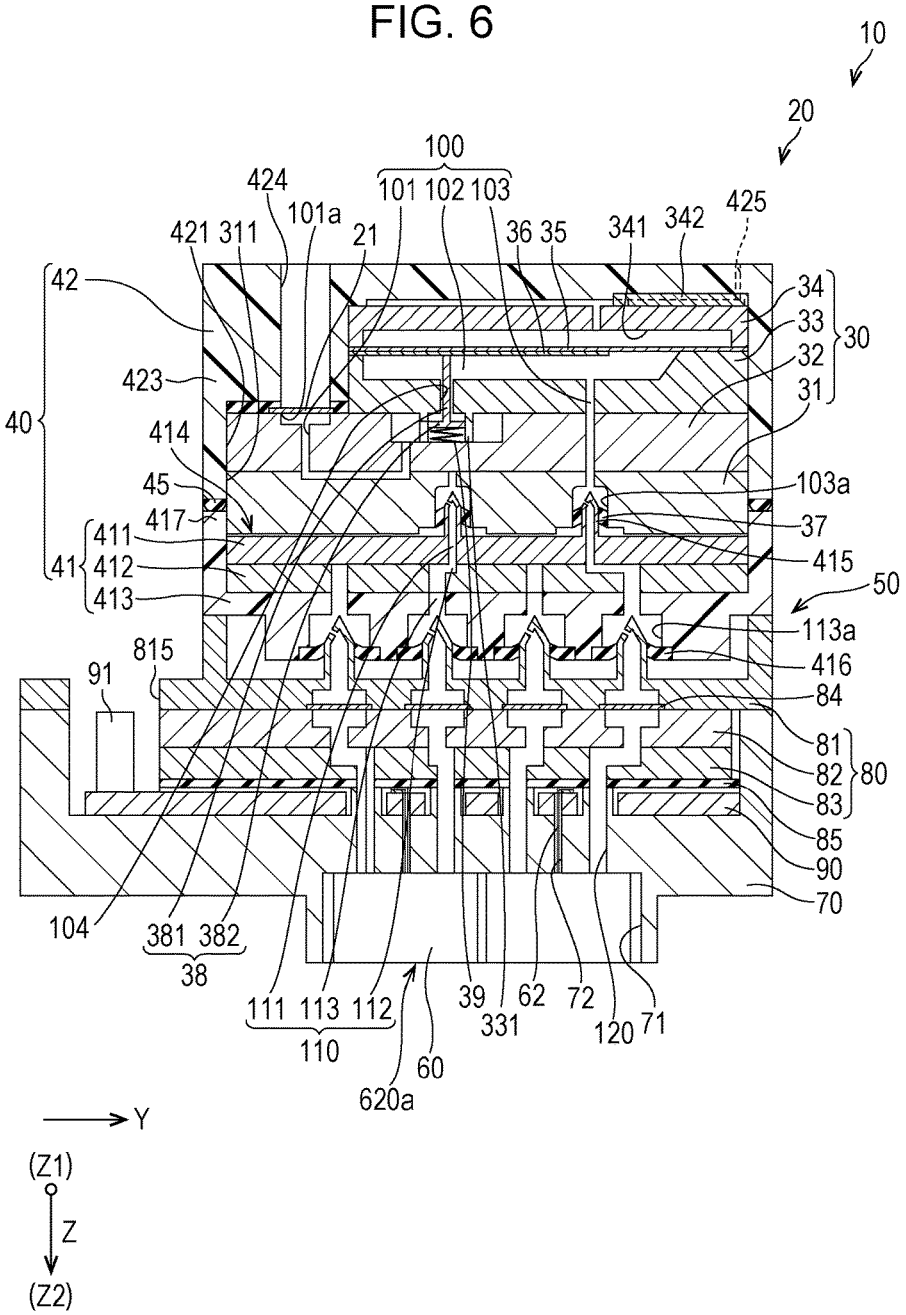
FIG. 6 is a cross-sectional view of a recording head according to Embodiment 2 of the invention.

FIG. 6 is a cross-sectional view of an ink jet recording head which is an example of a liquid ejecting head according to Embodiment 2 of the invention. Further, note that the same reference numerals are given to the same members as those in the above-described embodiment, and redundant description will be omitted.

As illustrated in FIG. 6, the ink jet recording head 10 of this embodiment includes the back pressure control unit 20 and the head unit 50.

The back pressure control unit 20 includes the back pressure control element 30 and the housing 40. Moreover, a second filter 21 is provided between the first openings 101*a* of the back pressure control element 30 and the liquid introduction openings 424 of the housing 40. As the material of the second filter 21, the same material as that of the first filter 84 can be used. Moreover, the second filter 21 has a higher opening ratio than the first filter 84. Further, note that the opening ratio refers to the ratio of opening per unit area. By making the opening ratio of the second filter 21 higher than that of the first filter 84, even if both the first filter 84 and the second filter 21 are provided, it is possible to suppress the pressure loss from becoming significantly large. Moreover, by providing the second filter 21, it is possible to prevent foreign matter such as dust contained in the ink from entering the downstream side of the second filter 21, that is, prevent foreign matter from entering the chambers 102 or the like, and it is possible to suppress malfunction of the valve body 38 due to foreign matter.

Embodiment 3

Figure 7:
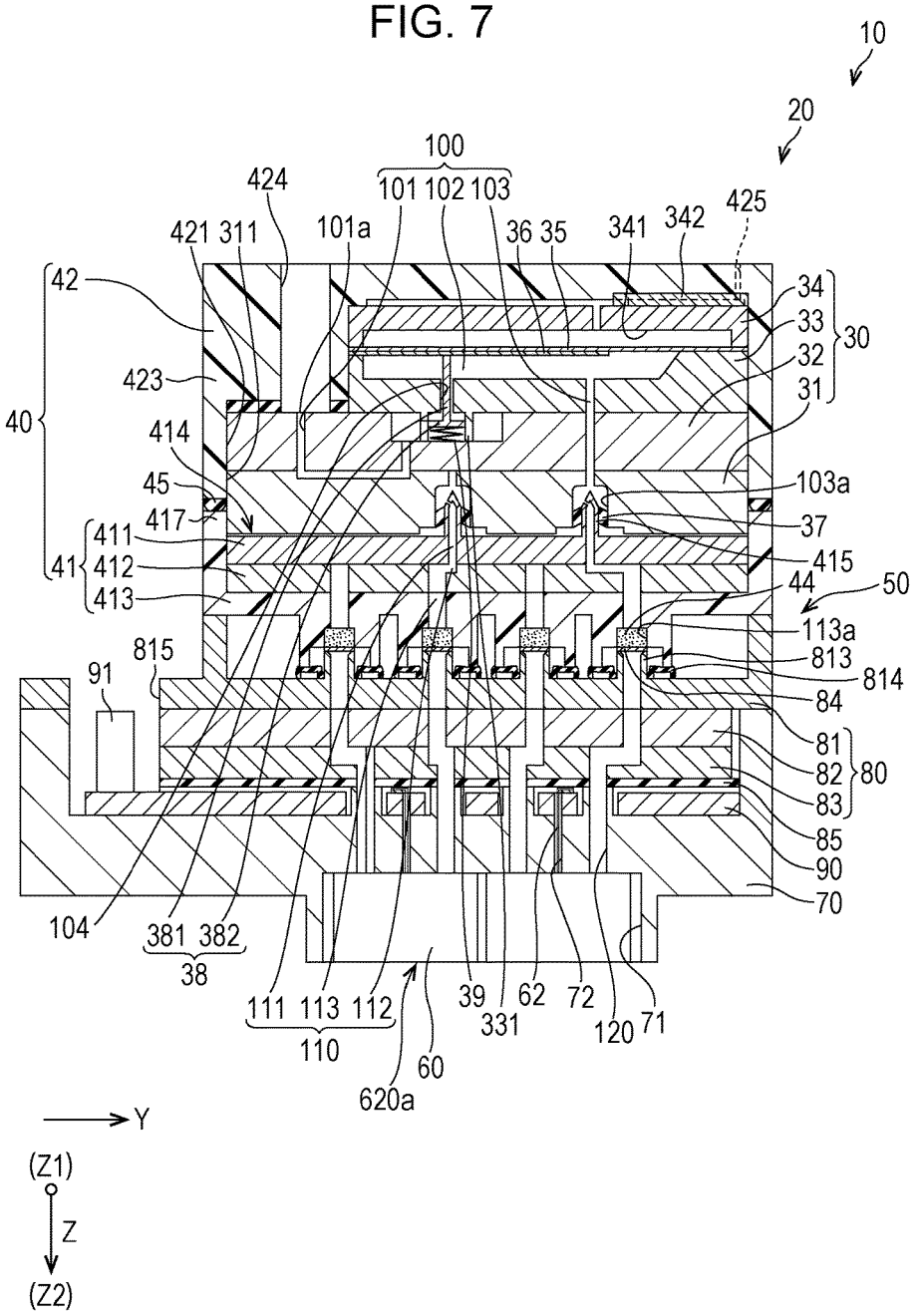
FIG. 7 is a cross-sectional view of a recording head according to Embodiment 3 of the invention.

FIG. 7 is a cross-sectional view of an ink jet recording head which is an example of a liquid ejecting head according to Embodiment 3 of the invention. Further, note that the same reference numerals are given to the same members as those in the above-described embodiment, and redundant description will be omitted.

As illustrated in FIG. 7, the ink jet recording head 10 of this embodiment includes the back pressure control unit 20 and the head unit 50.

The back pressure control unit 20 includes the back pressure control element 30 and the housing 40. The liquid discharge openings 113*a* are provided on the Z2 side surface of the housing 40, and an absorber 44 that absorbs ink is provided in each of the liquid discharge openings 113*a*. Examples of the absorber 44 include porous materials such as cotton-like pulp, polymeric water-absorbing polymer, and urethane foam, nonwoven fabric, and the like. Such an absorber presses against the first filter 84 of the head unit 50 and supplies the ink in the back pressure control unit 20 to the head unit 50.

On the second mounting portion 811 on the Z1 side of the head unit 50, an attachment portion 813 having a protruding shape protruding in a cylindrical shape on the Z1 side is provided. Each of the supply channels 130 is provided inside the attachment portion 813, and the first filter 84 is provided in each of the third openings 131*a* at the tip end on the Z1 side of the attachment portion 813. That is, in this embodiment, the first filter 84 does not extend between the first lid member 81 and the second lid member 82, but extends across each of the supply channels 130 (see FIG. 4) on the tip surface of the attachment portion 813.

In the ink jet recording head 10 such as that described above, by connecting the first filter 84, of the head unit 50, provided on a tip surface of the attachment portion 813 which has a protruding shape protruding toward the back pressure control unit 20 and the absorber 44 of the back pressure control unit 20 at the liquid surface level, each of the liquid discharge openings 113*a* of the back pressure control unit 20 and each of the third openings 131*a* of the head unit 50 are connected to each other.

Further, by providing fifth seal members 814 around attachment portions 813 of the head unit 50 and by bringing the fifth seal members 814 and protrusions protruding from the Z2 side surface of the back pressure control unit 20 into contact with each other, the connection portion of the absorber 44 and the first filter 84 is sealed.

Even with such a configuration, the back pressure control unit 20 can be easily attached to and detached from the second mounting portion 811 of the head unit 50 as in above-described Embodiment 1. Therefore, maintenance such as replacement and repair of the back pressure control unit 20 and cleaning of the back pressure control unit 20 can be easily performed.

Moreover, because the attachment portion 813 is provided in the second mounting portion 811 of the head unit 50 and the back pressure control unit 20 is attachable to and detachable from the second mounting portion 811 of the head unit 50, instead of the back pressure control unit 20, it is also possible to directly connect ink cartridges holding ink or the like. That is, the head unit 50 according to this embodiment can be used also for an ink jet recording head on which ink cartridges can be mounted, as well as an ink jet recording head on which the back pressure control unit 20 can be mounted. Therefore, it is not necessary to prepare a dedicated head unit for each of the ink cartridges and the back pressure control unit 20, the number of types of the head unit 50 can be reduced, and the cost of the head unit 50 can be reduced.

Embodiment 4

Figure 8:
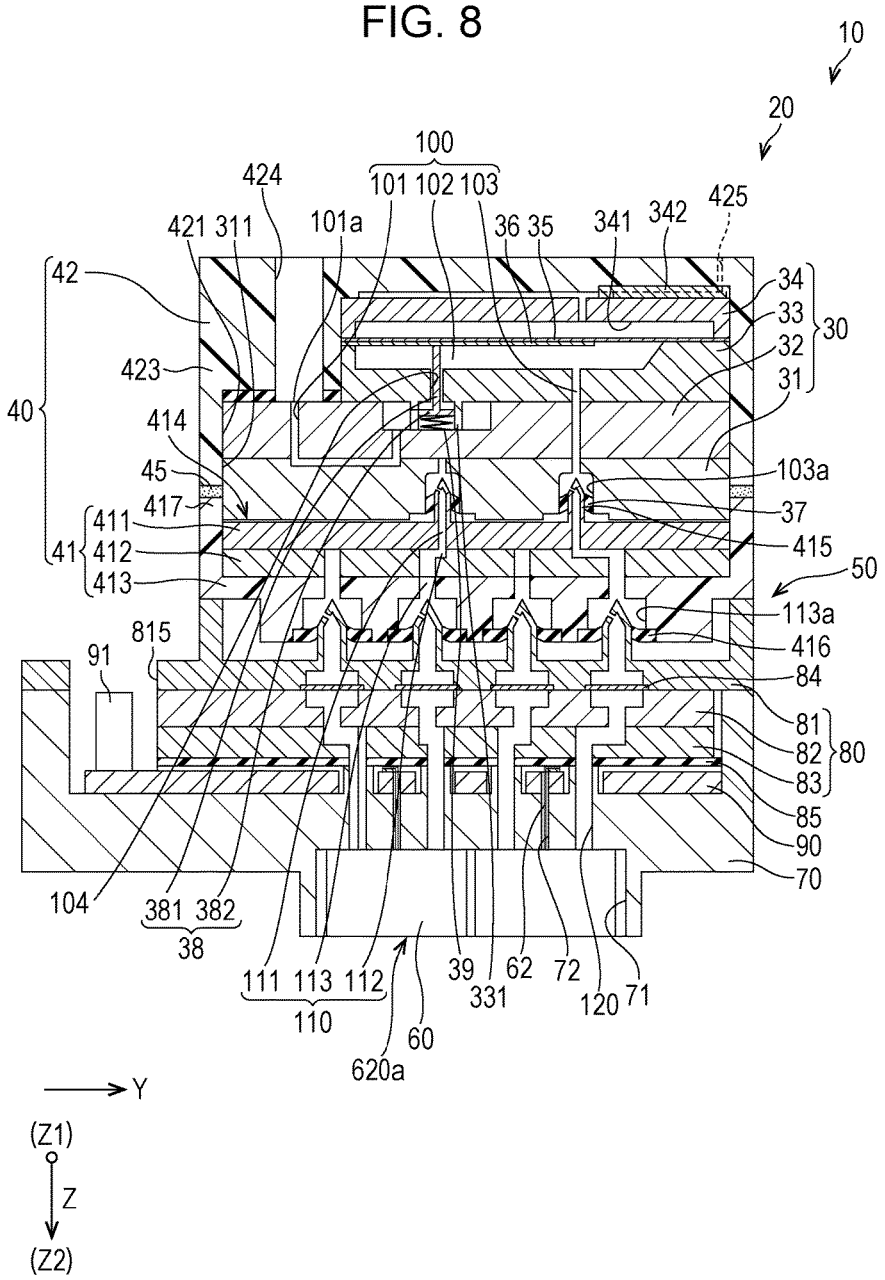
FIG. 8 is a cross-sectional view of a recording head according to Embodiment 4 of the invention.

FIG. 8 is a cross-sectional view of an ink jet recording head which is an example of a liquid ejecting head according to Embodiment 4 of the invention. Further, note that the same reference numerals are given to the same members as those in the above-described embodiment, and redundant description will be omitted.

As illustrated in FIG. 8, the ink jet recording head 10 of this embodiment includes the back pressure control unit 20 and the head unit 50.

The back pressure control unit 20 includes the back pressure control element 30 and the housing 40. The base portion 41 and the cover portion 42 of the housing 40 are fixed to each other by adhering the tip surfaces of the first wall portion 417 of the base portion 41 and the second wall portion 423 of the cover portion 42 with an adhesive 46.

Even with such a configuration, because a filter is not disposed between the liquid discharge openings 113*a* of the back pressure control unit 20 and the second openings 103*a* of the back pressure control element 30, it is possible to suppress an increase in pressure loss due to the overlapping of two filters and accumulation of bubbles in both filters.

Embodiment 5

Figure 9:
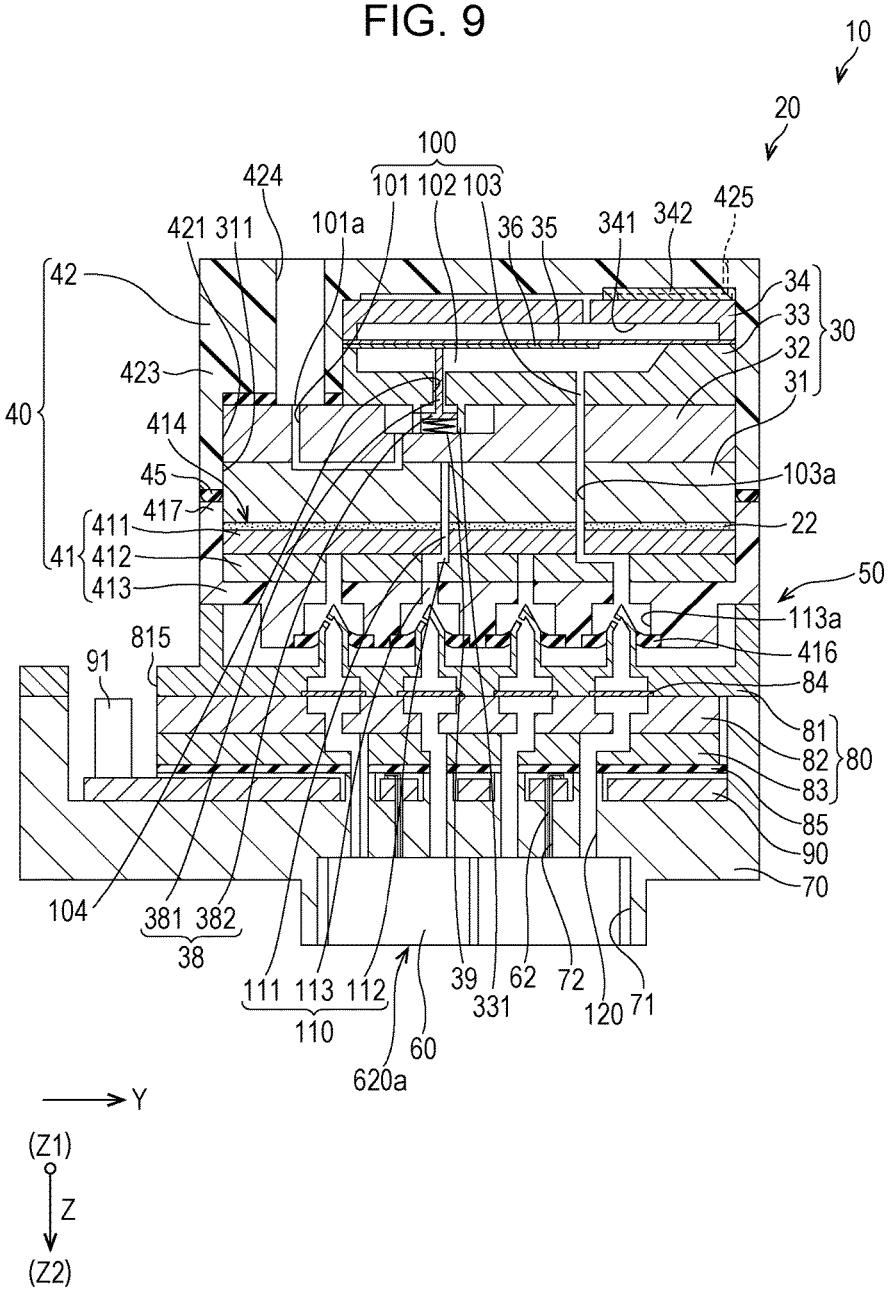
FIG. 9 is a cross-sectional view of a recording head according to Embodiment 5 of the invention.

FIG. 9 is a cross-sectional view of an ink jet recording head which is an example of a liquid ejecting head according to Embodiment 5 of the invention. Further, note that the same reference numerals are given to the same members as those in the above-described embodiment, and redundant description will be omitted.

As illustrated in FIG. 9, the ink jet recording head 10 of this embodiment includes the back pressure control unit 20 and the head unit 50.

The back pressure control unit 20 includes the back pressure control element 30 and the housing 40. Moreover, the second openings 103*a* of the back pressure control element 30 and the discharge channels 110 of the base portion 41 of the housing 40 are arranged such that the Z2 side surface of the back pressure control element 30 and the first mounting portion 414 of the base portion 41 of the housing 40 are adhered to each other with an adhesive 22.

Even with such a configuration, as in above-described Embodiment 1, because no filter is disposed between the liquid discharge openings 113*a* of the back pressure control unit 20 and the second openings 103*a* of the back pressure control element 30, it is possible to suppress the pressure loss caused by the overlapping of two filters and the accumulation of bubbles in both filters.

Other Embodiments

Although each embodiment of the invention has been described above, the basic configuration of the invention is not limited to those described above.

Figure 10:
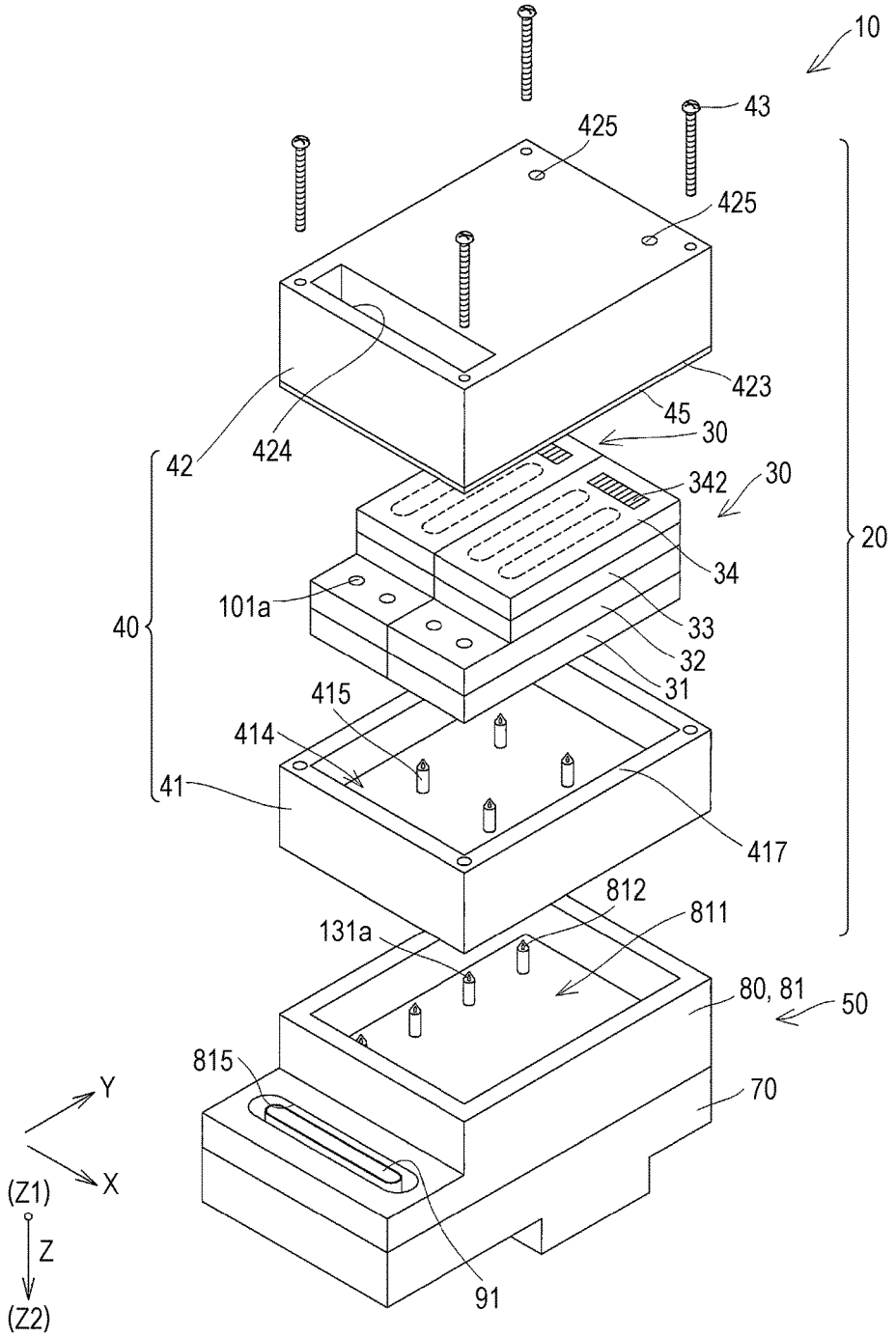
FIG. 10 is an exploded perspective view of a modified example of a recording head of the invention.

For example, in each of the above-described embodiments, a configuration in which only one backpressure control element 30 is provided inside the back pressure control unit 20 has been illustrated; however, the configuration is not particularly limited to this, for example, two or more back pressure control elements 30 may be provided for one head unit 50. Such an example is illustrated in FIG. 10. Further, FIG. 10 is an exploded perspective view of an ink jet recording head according to another embodiment.

As illustrated in FIG. 10, two back pressure control elements 30 are held inside the housing 40. With such a configuration, it is possible to suppress variations in characteristics of the on-off valve in the entirety of the back pressure control unit 20 caused by warpage of the back pressure control unit 20 and the characteristics of the back pressure control elements 30. Moreover, by merely changing the combination of the number of the back pressure control elements 30, it is possible to flexibly deal with design change.

Moreover, in each of the above-described embodiments, the first needle members 415 are provided on the housing 40 side and the first seal members 37 are provided on the back pressure control element 30 side; however, the configuration is not limited thereto, the first needle members 415 may be provided on the back pressure control element 30 side and the first seal members 37 may be provided on the housing 40 side. That is, either one of the back pressure control element 30 and the housing 40 may be provided with the first needle members 415 having a protruding shape protruding toward the other, and the other may be provided with the first seal members 37, which are elastic members that are tightly joined to the first needle members 415 each having a protruding shape.

Furthermore, in each of the above-described embodiments, the second needle members 812 are provided on the head unit 50 side and the second seal members 416 are provided on the back pressure control unit 20 side; however, the configuration is not limited thereto, for example, the second needle members 812 may be provided on the back pressure control unit 20 side and the second seal members 416 may be provided on the head unit 50 side. That is, either one of the back pressure control unit 20 and the head unit 50 may be provided with the second needle members 812 which have a protruding shape protruding toward the other, and the other may be provided with the second seal members 416 which are elastic members that are tightly joined to the second needle members 812 having a protruding shape. Further, similarly to the attachment portion 813 and the absorber 44 of Embodiment 3 described above, the back pressure control unit 20 may be provided with the attachment portion 813 and the first filter 84 and the head unit 50 may be provided with the absorber 44. However, in the case where the second needle members 812, the attachment portion 813 and the first filter 84 are provided on the back pressure control unit 20 side, when attaching the back pressure control unit 20 to the head unit 50, there is a possibility that the ink leaks onto the head unit 50. Therefore, it is preferable that the second needle members 812, the attachment portion 813, and the first filter 84 be provided on the head unit 50 side. Thus, leakage of ink can be suppressed.

Moreover, in each of the above-described embodiments, the housing 40 is formed so as to cover the entirety of the back pressure control element 30, but the housing 40 may be formed so as to cover at least the space in which the film member 35 of the back pressure control element 30 is formed.

Moreover, in above-described Embodiment 1, a thin-film piezoelectric actuator is used as a pressure generation element that causes a pressure change in each of the pressure-generation chambers 612; however, the configuration is not limited thereto, and, for example, a thick film-type piezoelectric actuator formed by attaching a green sheet or the like, a vertical-vibration-type piezoelectric actuator in which a piezoelectric material and an electrode material are alternately stacked and which expands and contracts in the axial direction, or the like can be used. Moreover, as a pressure generation element, a pressure generation element in which a heating element is disposed in a pressure generation chamber and liquid droplets are discharged from a nozzle opening by bubbles generated by heat generation of the heating element, or a so-called electrostatic actuator that generates static electricity between a diaphragm and an electrode, deforms the diaphragm by electrostatic force, and ejects liquid droplets from the nozzle opening can be used.

Figure 11:
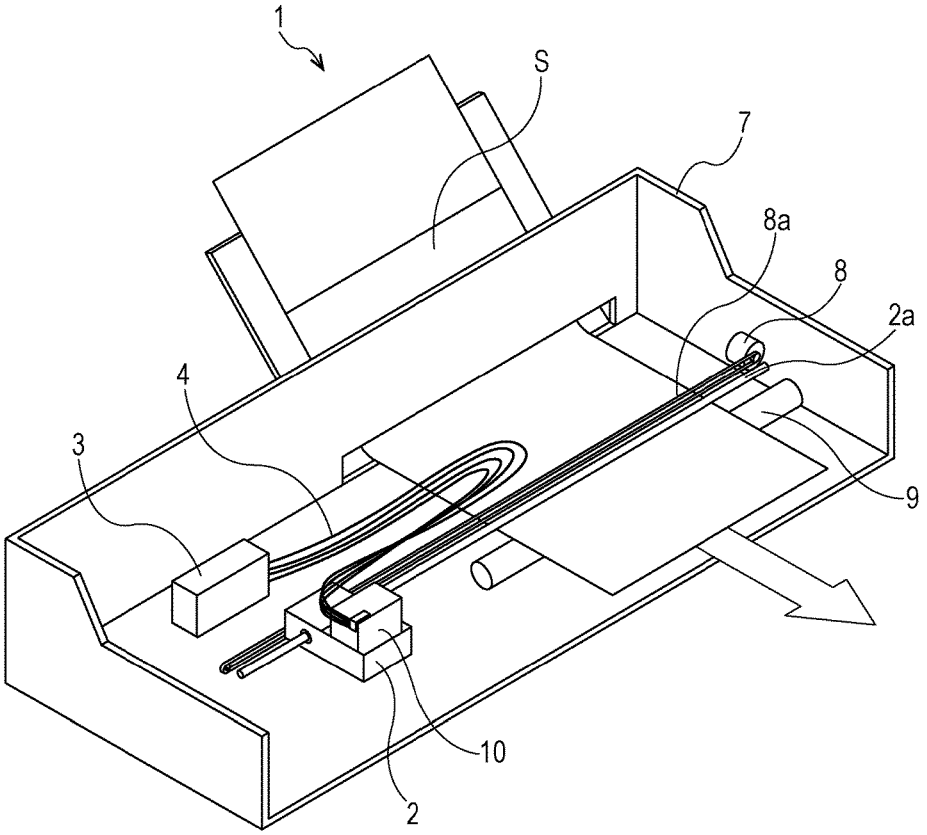
FIG. 11 is a schematic diagram of a recording apparatus according to an embodiment of the invention.

Moreover, the ink jet recording head of each of these embodiments forms a portion of an ink jet recording head unit having an ink flow channel that communicates with an ink cartridge or the like, and is mounted in an ink jet recording apparatus. FIG. 11 is a schematic diagram illustrating an example of the ink jet recording apparatus.

In an ink jet recording apparatus 1 illustrated in FIG. 11, the recording head 10 is mounted on a carriage 2. The carriage 2 on which the recording head 10 is mounted is provided so as to be movable in the axial direction along a carriage shaft 2*a* that is attached to an apparatus main body 7.

Moreover, the apparatus main body 7 is provided with a storage unit 3 formed of an ink tank in which ink is stored, and the ink from the storage unit 3 is supplied via a supply pipe 4 to the recording head 10 (the back pressure control unit 20) mounted on the carriage 2.

By transmitting the drive force of a drive motor 8 to the carriage 2 through a plurality of gears (not illustrated) and a timing belt 8*a*, the carriage 2 on which the recording head 10 has been mounted is made to move along the carriage shaft 2*a*. In contrast, the apparatus main body 7 is provided with a transport roller 9 as a transport unit, and a recording sheet S which is a recording medium such as paper is transported by the transport roller 9. Further, the transport unit for transporting the recording sheet S is not limited to a transport roller and may be a belt, a drum, or the like.

Moreover, in the ink jet recording apparatus 1 described above, the recording head 10 is mounted on the carriage 2 and moves in the main scanning direction; however, the configuration is not limited thereto, for example, the invention can also be applied to a so-called line type recording apparatus in which the recording head 10 is fixed to the apparatus main body 7 and printing is performed by simply moving a recording sheet S such as paper in a sub-scanning direction.

Furthermore, in the above-described example, the ink jet recording apparatus 1 including the recording head 10 provided with the back pressure control unit 20 has been described; however, the configuration is not limited thereto, and, for example, it may be an ink jet recording apparatus having the back pressure control unit 20 separately from the head unit 50. As an example of this, for example, when a storage unit such as an ink tank is not mounted on the carriage 2 but is held by the apparatus main body 7, and the storage unit is connected to the head unit 50 via a supply pipe such as a tube or the like, the back pressure control unit 20 may be provided in the middle of the storage unit or the supply pipe.

Further, in the above embodiment, an ink jet recording head is described as an example of a liquid ejecting head, and an ink jet recording apparatus is described as an example of a liquid ejecting apparatus; however, the invention is broadly intended for liquid ejecting heads and liquid ejecting apparatuses in general and can, of course, be widely applied to liquid ejecting heads and liquid ejecting apparatuses which eject a liquid other than ink. Examples of other liquid ejecting heads include various recording heads used in image recording apparatuses such as printers or the like, color material ejecting heads used for manufacturing color filters such as liquid crystal displays or the like, electrode material ejecting heads used for forming electrodes for organic EL displays, field emission displays (FEDs) or the like, bioorganic substance ejecting heads used for manufacturing biochips, or the like, and can also be applied to liquid ejecting apparatuses each including such a liquid ejecting head.

What is claimed is:

1. A liquid ejecting apparatus comprising:

a back pressure control unit including a back pressure control element that has a first opening, a second opening, a first liquid flow channel that enables the first opening and the second opening to communicate with each other, and a valve body that controls the flow of liquid in the first liquid flow channel, and a housing that houses the back pressure control element and in which a liquid introduction opening that communicates with the first opening and a discharge channel that communicates with the second opening are formed; and a head unit including a third opening connected to the discharge channel of the back pressure control unit, a second liquid flow channel that communicates with the third opening, a first filter disposed in the second liquid flow channel, a pressure generation chamber that communicates with the second liquid flow channel, a nozzle that communicates with the pressure generation chamber, and a pressure generation element that causes a pressure change in liquid in the pressure generation chamber and causes the liquid to be ejected from the nozzle, wherein a filter is not disposed between the discharge channel of the back pressure control unit and the second opening of the back pressure control element.

2. The liquid ejecting apparatus according to claim 1, wherein a second filter is disposed between the liquid introduction opening of the back pressure control unit and the first opening of the back pressure control element, and the second filter has a higher opening ratio than the first filter.

3. The liquid ejecting apparatus according to claim 1, wherein the head unit includes a lid portion in which the third opening is formed and which extends between the second liquid flow channel and the back pressure control unit, and one of the third opening and the discharge channel is formed in a protruding shape and the other is formed of an elastic member that is tightly joined to the protruding shape.

4. The liquid ejecting apparatus according to claim 1, wherein the head unit includes a lid portion in which the third opening is formed and which extends between the second liquid flow channel and the back pressure control unit, and one of the third opening and the discharge channel has an absorber which absorbs liquid and the other includes the first filter connected with the absorber at the liquid surface level.

5. The liquid ejecting apparatus according to claim 1, wherein the back pressure control element has a flexible film that forms a portion of a partition wall of the first liquid flow channel, the film being a single layer, and a water vapor barrier property of the housing of the back pressure control unit is higher than a water vapor barrier property of the film.

6. The liquid ejecting apparatus according to claim 1, wherein two or more back pressure control elements, each of which is the back pressure control element, are provided for the head unit.

* * * * *